US005401118A

United States Patent [19]

Kramer

[11] Patent Number: 5,401,118

[45] Date of Patent: Mar. 28, 1995

[54] COMPOSITION AND METHOD FOR COVERING SOIL

[76] Inventor: Fritz Kramer, 325 Beach Rd. Apt. 303, Tequesta, Fla. 33469

[21] Appl. No.: 94,511

[22] Filed: Jul. 20, 1993

[51] Int. Cl.[6] ..... E02D 3/12

[52] U.S. Cl. ..... 405/129; 405/258; 405/270; 405/267; 427/208

[58] Field of Search ..... 405/270, 129, 128, 258, 405/15, 16, 266, 267; 427/208

[56] References Cited

U.S. PATENT DOCUMENTS

| | | | |
|---|---|---|---|
| 2,599,359 | 6/1952 | Banks et al. | 427/208 X |
| 3,765,783 | 10/1973 | Wager | 405/270 X |
| 4,050,972 | 9/1977 | Cardinal | 405/270 X |
| 4,166,709 | 9/1979 | Valiga | 405/128 X |
| 4,207,017 | 6/1980 | Jarrell | 405/270 |
| 4,362,434 | 12/1982 | Valiga et al. | 405/128 |
| 4,420,533 | 12/1983 | Preiser et al. | 427/208 X |
| 4,582,737 | 4/1986 | Torgerson et al. | 427/208 X |

FOREIGN PATENT DOCUMENTS

| | | | |
|---|---|---|---|
| 1079783 | 3/1984 | U.S.S.R. | 405/270 |

*Primary Examiner*—Dennis L. Taylor
*Attorney, Agent, or Firm*—Michael A. Mann

[57] ABSTRACT

A composition and method for forming a water-impermeable barrier in soil such as for use in closing a waste disposal cell. The composition comprises a water-impermeable sheet to each side of which has been applied an adhesive such as polybutene. The sheet is a substantially nonflammable, water-impermeable, highly stretchable film, preferably a plasticized polyvinyl chloride-based or very low density polyethylene film. The composition is applied to a first layer of soil such as a landfill site and covered with a second layer of soil. When the first layer is sloped, several rows of the composition placed in adjacent, overlapping relationship, starting at the bottom of the slope. The soil particles in the first and second soil layers adhere to the sheet and enable the slope of the first layer to approach the shear angle for that type of soil. Thus, the disposal cell can have steeper sides and hold more waste than otherwise.

20 Claims, 1 Drawing Sheet

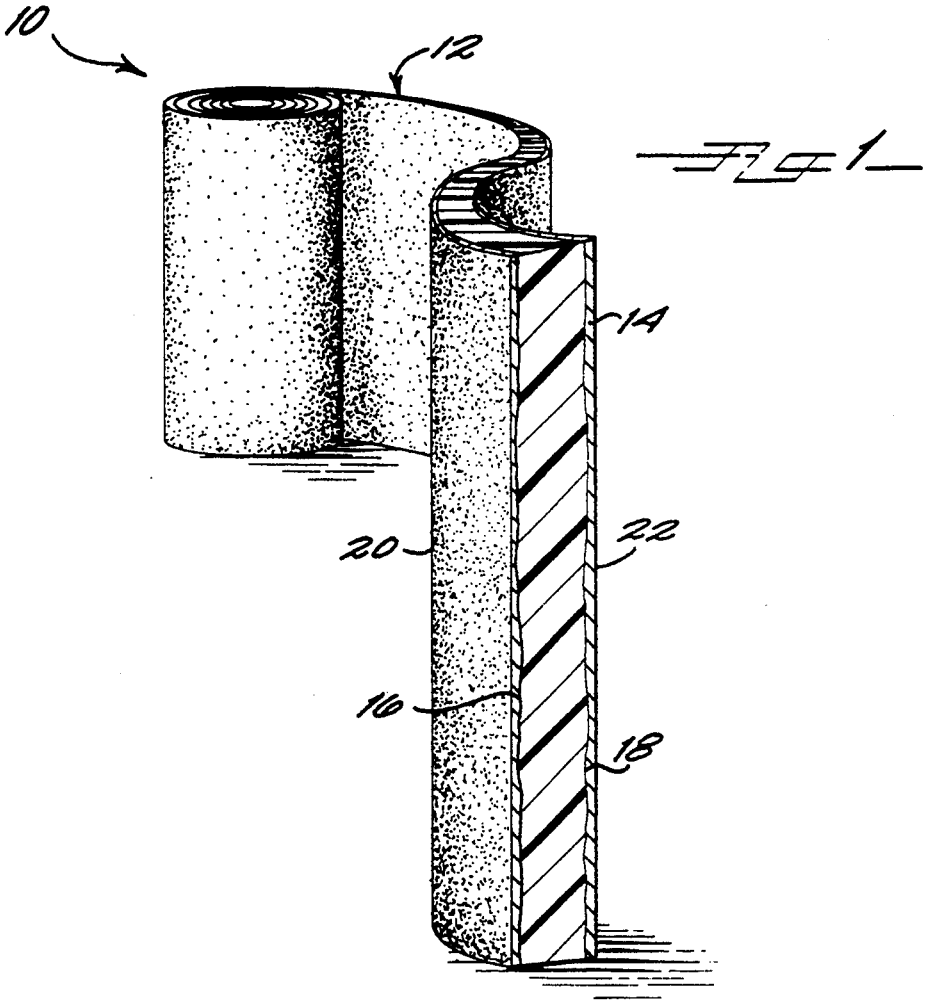
Fig. 1
Fig. 2
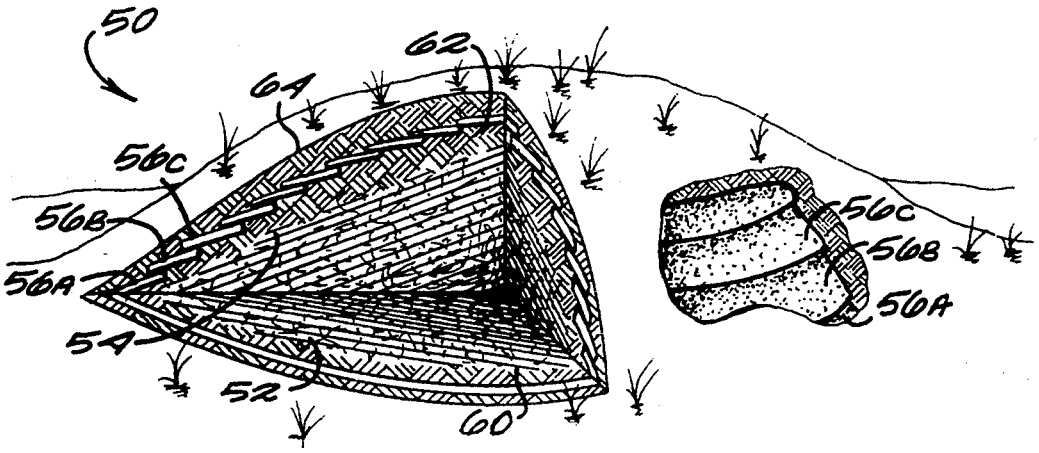

COMPOSITION AND METHOD FOR COVERING SOIL

BACKGROUND OF THE INVENTION

1. Field of the Invention

The present invention relates to a composition for covering soil, and a method for applying said composition to a soil surface. The invention further relates to a method for using the composition to form a water-impervious cover for landscaping, construction and landfills.

2. Discussion of Background

Household, commercial and industrial solid wastes are commonly transported to sanitary landfills for disposal. Federal and state regulations require that the disposed solid wastes deposited in a landfill cell must be covered with a "daily cover"—typically 6 inches (about 15 cm) of clean, compacted soil—by the end of each day. A thicker "intermediate cover" consisting of 12 inches (about 30 cm) of clean, compacted soil is applied if time will elapse before additional wastes are dumped at the same location, and a "final cover" is applied when a landfill cell is to be closed. The soil layers serve to control disease vectors, fire hazards, odors, water infiltration, blowing litter, and scavenging by wild animals such as birds and rodents.

Not all soils are suitable for use as covers. Very sandy soils are subject to wind erosion and rain run-off, and promote excessive seepage. Clayey soils are difficult to get. They are also susceptible to root penetrations, which in turn provide channels for water infiltration. Regulatory requirements also allow the use of cover materials other than clays to replace or supplement local soils.

Current regulations convert landfills from "biological reactors" for the decay of organic wastes to dry, waste "storage facilities." Stringent design criteria for landfills consider factors such as the hydrogeologic characteristics of the facility and the surrounding land, the characteristics of the soil in the area, existing groundwater quality and usage, climate, and the expected volume and physical and chemical characteristics of the leachate. A landfill must be provided with a bottom liner that includes a layer of compacted soil having low hydraulic conductivity (typically no more than $1\times10^{-7}$ cm/sec), leachate collection and removal systems, provisions for groundwater monitoring, and an approved plan for grading and final closure.

Closure requirements include a final cover system designed to minimize erosion of ground cover and water infiltration through the closed landfill. Typical state regulations require a low-permeability cover that includes a minimum of approximately 1 foot (about 0.3 m) of material that is capable of sustaining plant growth. The preferred final cover includes a type of soil that supports the growth of plants with well-developed root structures to help hold the soil and stabilize the landfill structure against erosion. The cover system must slope to promote positive drainage across the surface and prevent infiltration of surface water into the landfill, however, the slope must not be so great as to promote erosion. Slopes ranging from about 20° to 35° can be acceptable. Minimizing penetration of water into the landfill is important because surface water runoff can be disposed of to the environment, while rainwater that has percolated through a landfill is treated as leachate and must be treated as liquid waste, at potentially significant added expense.

A widely accepted and traditional method for closure is simply to cover the landfill with about 3 feet (about 0.9 m) of compacted clay. Many areas do not have readily available supplies of suitable clays. In addition, new regulations require a water-tight final cover in order to keep the entombed waste dry. Therefore, the clay cap has become inadequate due to roots from vegetation forming channels through the clay cover. However, equally effective materials may be substituted, and various synthetic materials have been suggested and are already being used for landfill closures. The preferred materials are polyvinyl chloride (PVC), very low density polyethylene (VLDPE), or similar pliable, substantially water-impermeable polymer membranes sandwiched between two layers of compacted soil. These membranes stop roots from penetrating into the waste. They allow the landfill operator to use available soils instead of buying clays, and also reduce rainwater infiltration into the stored waste.

These membranes have smooth, slippery surfaces, and, when embedded between layers of soil, tend to foster soil slippage as the angle of the slope increases. Various techniques are available to alleviate this problem, including reducing the surface slope of the landfill, terracing the slope, constructing embankments or ridges across the slope to intercept surface runoff, and embedding the film between two layers of nonwoven geotextile. Reducing the slope or terracing the sides of a landfill entails a substantial increase in cost and the use of large amounts of soil to achieve adequate closure. An ideal composition for use in landfills would be a geomembrane that is nonflammable, impermeable to water, and limits slippage of overburden.

There is a need for a nonflammable, water-impermeable composition that can be used to cover soil without causing undue slippage of the overburden and is simple and economical to manufacture.

SUMMARY OF THE INVENTION

According to its major aspects and broadly stated, the present invention is a composition and method for use in covering soil. In a preferred embodiment, the composition comprises a flexible sheet, with each side of the sheet carrying a layer of adhesive. The sheet is a nonflammable, water-impermeable, highly stretchable film, preferably a plasticized polyvinyl chloride-based membrane.

The composition is laid out onto the soil surface to be covered. The surface may be a layer of soil over a solid waste landfill cell, or some other site where it is desirable to reduce the amount of water that can penetrate the surface. When placed on a sloping surface, several rows of adjacent overlapping sheets of the composition are used. The first row is placed at the bottom of the slope and each succeeding sheet is lapped over the previous sheet in a manner similar to siding or roofing shingles; that is, the next sheet is placed up-slope and arranged so that the down-slope edge of that sheet rests on top of the previous sheet. Then, a layer of soil is placed over the barrier formed by the overlapped sheets. The overlapping layers adhere to each other and to the soil below and above. Water that penetrates the soil layer is substantially diverted by the structure and flows downwards towards the bottom of the slope.

When compared to polymer film alone, the composition significantly increases the angle of interface shear (hereinafter, the "shear angle" which means the angle at which the soil begins to slide down slope) of the overlying soil cover because it reduces the tendency of the soil to slide downwards. Therefore, the maximum attainable slope—and the landfill cell volume—are increased by use of the present composition over conventional, smooth films or membranes. The shear angle using the present composition is essentially unchanged from that found for soil alone. The maximum attainable slope, and therefore the available landfill cell volume, are higher than for uncoated polymer film or standard geomembrane. Furthermore, less overburden is needed to cover a landfill cell of a given volume.

The two adhesive layers of the composition are an important feature of the present invention. The adhesive used for the layers is an adhesive with low peel strength, such as polybutene. Each layer need have no more than approximately 10 lbs/1,000 $ft^2$ (about 0.05 $kg/m^2$) adhesive to effectively adhere soil particles.

Another important feature of the present invention is the combination of the flexible sheet and two adhesive layers, one on either side of the sheet. When the composition is placed on a surface to be covered, one of the adhesive layers adheres to the surface and the other layer adheres to a second soil layer applied over the composition. Because the soil particles adjacent to the composition on both sides adhere to the adhesive, the composition remains in position and the possibility of slippage of the overburden is reduced. The shear angle of the soil cover is essentially that found for soil alone, that is, for soil without an intervening water-impermeable sheet and much higher than for a soil layer with a layer of smooth plastic under it. Because the adhesive layers are separated by the water-impermeable sheet, water penetrating the top layer flows over rather than through the composition, so less water percolates into the lower layer.

The composition is self-sealing for small punctures (pinprick size or thereabouts). The adhesive flows over a small puncture, sealing the puncture and preventing water from penetrating.

Another feature of the present invention is the flexible sheet itself. The sheet is nonflammable, water-impermeable, and drapeable over the expected range of temperatures in the environment of use, such as polyvinyl chloride (PVC) film. The film may be plasticized to increase its pliability and other additives such as root growth retardants may be added. The sheet is sturdy enough to support a layer of soil, but light enough for easy handling. Importantly, the film is highly stretchable so that, when placed on a soil surface or sandwiched between two layers of soil, the film can stretch easily to conform to the contours of the soil layers without puncturing or tearing.

Still another feature of the present invention is the method of applying the composition to a contoured soil surface, overlapping successive rows in a manner similar to roofing shingles. Because the adhesive adheres to the soil, the composition need not be modified in some way to maintain the soil in position, such as by texturing it.

Another feature of the present invention is the way the adhesive is applied, namely, by applying the adhesive to one side of a sheet and then rolling the sheet. The adhesive is automatically transferred to the other side in the rolling process.

Other features and advantages of the present invention will be apparent to those skilled in the art from a careful reading of the Detailed Description of a Preferred Embodiment presented below and accompanied by the drawings.

BRIEF DESCRIPTION OF THE DRAWINGS

In the drawings,

FIG. 1 shows a composition according to a preferred embodiment of the present invention; and FIG. 2 shows the composition of FIG. 1 in use.

DETAILED DESCRIPTION OF A PREFERRED EMBODIMENT

Referring now to FIG. 1, there is shown a roll 10 of a composition 12 according to a preferred embodiment of the present invention. Composition 12 includes a flexible sheet 14 having a first side 16 and a second side 18. First side 16 carries a first adhesive layer 20; second side 18 carries a second adhesive layer 22.

Sheet 14 is nonflammable and highly flexible, stretchable and drapeable over the expected range of temperatures in the environment of use. Drapeable means that sheet 14 has little or no resiliency and will therefore easily follow the contours of a surface. This range of temperatures includes typical outside temperatures which may go down to zero degrees Fahrenheit (about −18° C.) and lower and as high as 120° Fahrenheit (about 49° C.) or more. Suitable materials for sheet 14 include polyvinyl chloride (PVC) film, very low density polyethylene (VLDPE) film, or some other polymer film with similar properties. Preferably, the material of sheet 14 is plasticized to increase its pliability. Suitable plasticizers include tricresyl phosphate ($(CH_3C_6H_4O)_3PO$). Other additives such as root growth inhibitors may be incorporated into sheet 14 if desired.

Membranes or films suitable for use with the present invention are available from various manufacturers of films of different chemistry, such as PVC or VLDPE. The films are supplied in thicknesses ranging from 5–30 mil (about 0.013–0.076 cm), weights of approximately 50– 300 lb/1,000 $ft^2$ (about 0.24–1.5 $kg/m^2$), and widths of 6′–9′ (about 1.8–2.7 m), in rolls of several hundred yards or meters in length.

Sheet 14 is impermeable to water in order to divert rainwater or surface run-off from penetrating into the landfill. Sheet 14 is also preferably treated to be resistant to the effects of ultraviolet light so as to prevent deterioration upon exposure to sunlight, nontoxic, and requires no special precautions in storage and handling.

Sheet 14 is pliable and highly stretchable, so that, when placed on a surface, sheet 14 conforms to the contours of the surface without breaking or cracking. Typically, landfill sites are graded and dressed (smoothed) before closure. However, some irregularities inevitably remain or develop because soil is granular. Also, settling may produce surface indentations that must be bridged by the cover material. Therefore, sheet 14 has at least approximately 250% elongation or elasticity, that is, the sheet can be stretched to at least approximately two and a half times its original length or width without breaking. Preferably, sheet 14 has up to 300% or higher elongation.

Adhesive layers 20, 22 are made of a permanently tacky, nonhardening adhesive. Suitable adhesives for layers 22, 22 include, but are not limited to, polymeric adhesives such as polybutene, the polyterpenes, polyamides based on dimerized fatty acids, polyvinyl ethers and polyacrylates. However, polybutene, a polymer of isobutene ($(CH_3)_2CCH_2$)) is preferred. Polybutene in a suitable molecular weight for use as an adhesive is available from a number of sources, including the water emulsion of polybutene marketed by the Exxon Chemical Co. of Houston, Tex. under the trademark PARAMIN.

Adhesive layers 20, 22 can be applied to sheet 14 in a number of ways. The preferred method for preparing composition 12 is to start with a sheet of suitable material, such as PVC film. The material may be supplied in the form of cut lengths or rolls. Sheet 14 is laid out on a level surface, and a suitable adhesive is applied uniformly to the upper surface, which can be either side 16 or side 18. Of course, sheet 14 may coated while in a generally vertical position. The adhesive can be brushed, rolled or sprayed on easily. If desired, the adhesive can be applied to sheet 14 in the form of a foam.

After the adhesive is applied to one side of sheet 14, the sheet is rolled up towards coated side 1.6 (or side 18) so that the coated side contacts uncoated side 18 (or side 16). Alternatively, sheet 14 is unrolled from one roll, side 16 or side 18 is coated with the adhesive, and sheet 14 is rolled onto a second roll. When sheet 14 is rolled up, side 16 engages side 18 and some of the adhesive is transferred from the coated side to the uncoated side. However, the adhesive can be applied separately to each side of sheet 14 if desired. Furthermore, although most applications will be satisfied by using the same adhesive on both sides, conceivably different adhesives can be used where for example, different soils are used for the underlying layer and the overburden, or where the adherence between adjacent, overlapping layers is enhanced by applying different formulations of adhesive to opposing sides of the sheet. Different adhesives may be especially useful where synthetic soils or partially synthetic soils are used.

Composition 12 can easily be unrolled for use. When unrolled, approximately half the adhesive coating is carried by side 16 as layer 20, and half by side 18 as layer 22. Rolled-up composition 12 can be placed into a tube for storage and transportation. Alternatively, composition 12 can be folded into rectangular Z-folds for storage.

Layers 20, 22 can be characterized by the amount of adhesive that is spread onto sheet 14. When a polybutene adhesive is used, approximately 10–20 lb/1,000 $ft^2$ (0.05–0.10 $kg/m^2$) of adhesive is used, approximately 5–10 lb/1,000 $ft^2$ (about 0.025–0.05 $kg/m^2$) on each side of sheet 14. Preferably, each side of sheet 14 carries approximately 5 lb/1,000 $ft^2$ (about 0.025 $kg/m^2$).

At the landfill site, composition 512 is unwrapped or unpacked and laid out onto the surface to be covered. The adhesive used for layers 20, 22 has a low peel strength, so composition 12 can easily be unrolled or unfolded for use. As illustrated schematically in FIG. 2, a landfill cell 50 contains solid waste 52 covered by a layer of soil 54. Alternatively, site 50 may be any outdoor construction site where it is desired to prevent excessive water influx into a subsurface region, such as a roadbed, home construction site, a slope, landscaped soil, and so forth.

Several rows **56*a*, 56*b*, 56*c*, and so forth of composition 12 are placed over soil layer 54. The adhesive coatings (layer 20 or layer 22) of rows 56*a*, 56*b*, and so forth adhere to the underlying soil, causing the rows to remain in position. Composition 12 is applied in successive rows from the bottom 60 to the top 62 of soil layer 54. Rows 56 are covered by a layer of soil 64 to complete closure of site 50**.

As shown in FIG. 2, rows 56 are preferably lapped in a manner similar to siding, so that surface water flowing over cell 50 is diverted over rows 56 instead of being directed into underlying soil layer 54 and waste 52. The structure formed by rows 56 sheds water, thereby reducing the amount of leachate created when rain falls on cell 50 and percolates through waste 52. The overlapping edges of rows 56 tend to adhere to one another. As noted above, any rainwater that has penetrated into waste 52 must be collected and treated before discharge. By reducing the amount of leachate, the cost of collection and treatment are reduced substantially, as is the risk of groundwater pollution.

The angle of interface shear (the shear angle) is a measure of the maximum attainable slope of a type of soil, that is, a measure of the natural propensity of the soil to slide. Shear angles range between approximately 20° and 45° depending on the type of soil. Typically, higher angles are found for clayey soils and smaller angles for fine, sandy soils. When a polymer film is sandwiched between two layers of soil, the soil slides more easily against the film than against itself so the shear angle is reduced. With composition 12, adhesive layers 20, 22 capture grains of soil and hold the grains as though there were no film 14 inbetween.

A composition 12 consisting of a 6 mil (0.006 inches; about 0.015 cm) PVC film coated on both sides with emulsified polybutene adhesive (Exxon brand PARAMIN) was covered with a layer of soil. The soil shear angle was 35°, approximately the same angle that would be found for soil alone. The slope of the soil layers was higher than the achievable slope using standard geomembranes or uncoated polymer films, where lower shear angles necessitate reduced surface slopes.

Wherever composition 12 is covered with a layer of soil, the actual angle of interface shear is determined by the type of soil, the material of sheet 14, and the adhesive used for layers 20, 22. By increasing the shear angle over that found for a conventional polymer film covered with soil, composition 12 allows more flexible landfill design. Specifically, steeper attainable slopes mean that more waste can be placed over a smaller area, with less water retention and penetration into the stored waste. Of course, the optimum slope for a particular landfill site depends on factors such as the soil type, the necessity for access, and the need to prevent erosion and slippage. Some terracing may be required to ensure vehicle access to the site.

Adhesive from layers 20, 22 migrates into small punctures such as pinpricks in sheet 14, sealing the punctures and preventing water from penetrating through sheet 14. Composition 12 is highly stretchable, preferably with an elongation of about 250% or higher. Therefore, composition 12 readily bridges soil particles at the surface of soil layer 54. Composition 12 also conforms to the structure of upper soil layer 64 when the layer is applied and compacted. Any small punctures (pinpricks) will be filled by the adhesive.

It will be apparent to those skilled in the art that many changes and substitutions can be made to the preferred embodiment herein described without departing from the spirit and scope of the present invention as defined by the appended claims.

What is claimed is:

1. A composition for use in forming a barrier to water penetration through soil, said composition comprising:

a water-impermeable sheet having a first side and a second side;

a first adhesive layer carried by said first side of said sheet; and a second adhesive layer carried by said second side of said sheet, said first and second adhesive layers enabling particles of said soil to adhere to said first and said second sides of said sheet so that a first layer of soil applied to said first side of said composition does not readily shift with respect to a second layer of soil applied to said second side of said composition, said composition preventing water from passing from said first layer of soil to said second layer of soil.

2. The composition as recited in claim 1, wherein said sheet is made of substantially nonflammable material having at least approximately 250% stretchability.

3. The composition as recited in claim 1, wherein said sheet further comprises polyvinyl chloride film.

4. The composition as recited in claim 1, wherein said sheet further comprises polyvinyl chloride and tricresyl phosphate film.

5. The composition as recited in claim 1, wherein said sheet has a thickness between approximately 5–30 mil.

6. The composition as recited in claim 1, wherein said sheet weighs between approximately 50–300 pounds per 1,000 $ft^2$.

7. The composition as recited in claim 1, wherein said first and second adhesive layers are both non-hardening.

8. The composition as recited in claim 1, wherein each of said first and said second adhesive layers further comprises an adhesive selected from the group consisting essentially of polybutene, polyterpenes, polyamides based on dimerized fatty acids, polyvinyl ethers and polyacrylates.

9. The composition as recited in claim 1, wherein each of said first and said second adhesive layers further comprises an adhesive made of an emulsion of water and polybutene.

10. The composition as recited in claim 1, wherein each of said first and second adhesive layers further comprises approximately 5–10 pounds of adhesive applied per 1,000 $ft^2$ of said sheet.

11. The composition as recited in claim 1, wherein said first and second adhesive layers are applied to said sheet by a process comprising the steps of:

coating said first side of said sheet with a quantity of an adhesive; and transferring at least a portion of said adhesive to said second side of said sheet by rolling up said sheet.

12. The composition as recited in claim 1, wherein said first and second adhesive layers are applied to said sheet by a process comprising the steps of:

coating said first side of said sheet with approximately 10–20 lb/1,000 $ft^2$ of an adhesive; and transferring at least a portion of said adhesive to said second side of said sheet by rolling up said sheet.

13. A method for covering a first layer of soil to impede the flow of water into said soil surface, said method comprising the steps of:

placing at least one substantially water-impermeable sheet onto said first layer, said sheet having two sides, said sheet coated on each of said two sides with a layer of soil-adhering adhesive; and covering said sheet with a second layer of soil.

14. The method as recited in claim 13, wherein said at least one sheet is a plurality of sheets, wherein said placing step further comprises the steps of:

placing a first sheet; and placing a next sheet adjacent to and overlapping said first sheet.

15. The method as recited in claim 13, wherein said at least one sheet is a plurality of sheets and said first layer of soil has a slope with an up-slope and a down-slope, wherein said placing step further comprises the steps of:

placing a first sheet down-slope; and placing a next sheet adjacent to, up-slope from and overlapping said first sheet.

16. A method of closing a waste disposal cell, said cell containing waste, said method comprising the steps of:

covering said waste with a first layer of soil;

placing a plurality of sheets of a substantially water-impermeable material having two sides onto said first layer of soil, each of said two sides being coated with a layer of soil-adhering adhesive; and covering said plurality of sheets with a second layer of soil, said adhesive layers enabling particles of said soil to adhere to said two sides of said material so that said first layer of soil does not readily shift with respect to said second layer of soil, said plurality of sheets preventing water from passing from said first layer of soil to said second layer of soil.

17. The method as recited in claim 16, wherein said placing step further comprises the steps of:

placing a first sheet of said plurality of sheets onto said first layer of soil; and placing a next sheet of said plurality of sheets adjacent to and overlapping said first sheet.

18. The method as recited in claim 16, wherein said first covering step further comprises the step of covering said waste so that said first layer has a slope, said first layer having an up-slope and a down-slope, and said placing step further comprises the steps of:

placing a first sheet down-slope; and placing a next sheet adjacent to, up-slope from and overlapping said first sheet.

19. The method as recited in claim 16, wherein said first covering step further comprises the step of covering said waste so that said first layer has a slope approximately equal to the shear angle of said first layer of soil.

20. The method as recited in claim 16, further comprising the step of planting vegetation in said second layer of soil.

* * * * *